US007832924B2

(12) United States Patent
Nagasaka

(10) Patent No.: US 7,832,924 B2
(45) Date of Patent: Nov. 16, 2010

(54) TIMEPIECE

(75) Inventor: Eiichi Nagasaka, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 422 days.

(21) Appl. No.: 12/047,647

(22) Filed: Mar. 13, 2008

(65) Prior Publication Data

US 2008/0239883 A1 Oct. 2, 2008

(30) Foreign Application Priority Data

Mar. 27, 2007 (JP) ..... 2007-080865
Dec. 11, 2007 (JP) ..... 2007-319271

(51) Int. Cl.
*G04B 1/10* (2006.01)
*G04B 9/00* (2006.01)
*G04B 23/00* (2006.01)

(52) U.S. Cl. ..... 368/140; 368/147; 368/210

(58) Field of Classification Search ..... 368/140, 368/141, 145–147, 206, 209, 210, 212
See application file for complete search history.

(56) References Cited

U.S. PATENT DOCUMENTS 161,957 A * 4/1875 Hanson ..... 368/140
167,372 A * 8/1875 Wheeler ..... 368/140
942,374 A * 12/1909 Buhler ..... 368/140

FOREIGN PATENT DOCUMENTS

CH 279954 A 12/1951
EP 0950931 A 10/1999
EP 1914604 A 4/2008
JP H08-005758 A 1/1996
JP 2000-002773 A 1/2000

* cited by examiner

*Primary Examiner*—Vit W Miska
(74) *Attorney, Agent, or Firm*—Global IP Counselors, LLP

(57) ABSTRACT

A timepiece having a mainspring, an output wheel that is rotated by torque output from the mainspring, a lever that pivots synchronously to the output wheel, and a pressure member that pushes the lever. The pressure member pushed the lever so that the output torque of the output wheel increases as the mainspring unwinds.

8 Claims, 15 Drawing Sheets

TIMEPIECE

BACKGROUND

1. Field of Invention

The present invention relates to a timepiece, and relates more particularly to a timepiece that has a winding wheel train that is driven when a mainspring is wound, and an unwinding wheel train that is driven when the mainspring unwinds.

2. Description of Related Art

Watches (wristwatches) that drive a wheel train using a mainspring as the mechanical energy source include conventional mechanical watches and, more recently, electronically-controlled mechanical timepieces such as taught in Japanese Unexamined Patent Appl. Pub. JP-A-HO8-5758. When the mainspring that is generally used in such timepieces is wound, the final wind causes the torque stored in the mainspring to rise sharply as indicated by curve A in FIG. 4, and the mainspring outputs extremely high torque when the mainspring is released and first begins to unwind. This applies high torque to the governor, escapement, or other limiting means used to control the speed of the wheel train that is driven by the mainspring, and can potentially damage these parts.

Clocks, particularly table clocks and wall clocks, therefore use a winding limiter to stop the mainspring from being wound more than a specific number of winds. This winding limiter uses a geneva drive type winding limiter mechanism that has a rotating member called a pin that is fixed to and rotates in conjunction with the barrel arbor, and a wheel called a Maltese cross that is attached to the barrel. This geneva drive limiter mechanism tends to be relatively large due to the need to assure sufficient strength in the pin and wheel, and must be disposed on the barrel. It can therefore only be used in clocks that are large enough to afford enough internal space, and cannot be easily used in watches with little internal space.

To address this problem, we developed a mechanism that can be used even in watches and other timepieces with little internal space to prevent the mainspring from outputting extremely high torque, that is, a mechanism that keeps the torque output of the mainspring always within a set torque range. See, for example, Japanese Unexamined Patent Appl. Pub. JP-A-2000-2773.

In a timepiece that is powered by a mainspring, the torque output from the mainspring necessarily decreases as the mainspring unwinds. This occurs even when the torque from the mainspring is controlled to within a preset range as described in Japanese Unexamined Patent Appl. Pub. JP-A-2000-2773, except in this case the torque output decreases gradually within the set range.

When the torque declines as the mainspring unwinds in a conventional mechanical timepiece, the swing angle of the balance in the governor decreases and precision drops. In an electronically-controlled mechanical timepiece, the energy that is needed to generate power cannot be sustained as the torque that drives the generator decreases, and the operating time of the timepiece cannot be increased.

While a high spike in the output torque is prevented on the mainspring winding side, the swing angle of the balance increases in a mechanical timepiece and precision again drops. Torque can even exceed the control range of the generator brake in an electronically-controlled mechanical timepiece, and assuring the required precision may not be possible.

SUMMARY

A timepiece according to the present invention eliminates the drawbacks to using a mainspring as the drive power source, and affords stable precision and increasing the operating time of the timepiece.

A timepiece according to a first aspect of the invention has a mainspring, an output wheel that is rotated by torque output from the mainspring, a lever that pivots synchronously to the output wheel, and a pressure member that pushes the lever. The pressure member pushes the lever so that the output torque of the output wheel increases as the mainspring unwinds.

The total torque that drives the timepiece is the torque combining the torque output from the mainspring and the torque applied to the output wheel by the pressure from the lever. Because the torque applied to the output wheel increases as the mainspring unwinds, this additional torque assists the decreasing torque from the mainspring as the mainspring unwinds. The problem of reduced precision resulting from the large difference between the torque output of the mainspring when the mainspring is fully wound and the torque output when the mainspring is unwound is therefore solved, and stable timekeeping can be assured. Furthermore, because the torque applied to the output wheel increases as the mainspring unwinds, the timepiece can be driven beyond the point where the timepiece stops when the mainspring unwinds in a conventional timepiece, and the timepiece can be driven for a longer continuous operating time.

In a timepiece according to another aspect of the invention the pressure member preferably pushes the lever to the lever pivot point or near the lever pivot point when the mainspring is fully wound, and pushes the lever so that the output torque of the output wheel increases as the mainspring unwinds.

By pushing the lever to or near the pivot point of the lever when the mainspring is fully wound, the torque added to the output wheel by pressure from the lever is zero or nearly zero in this aspect of the invention, and the lever can be held in a stable position. The lever being stably positioned produces a load on the mainspring as the mainspring tries to unwind, and can thereby reliably reduce the large output torque of the mainspring when the mainspring is fully wound.

On the other hand, when the mainspring has unwound, the pressure member pushes the lever in the direction increasing the output torque of the output wheel, and can thus reliably produce output torque on the output wheel. By thus reliably increasing the output torque produced at the output wheel as the mainspring unwinds, the total torque combining this additional torque and the torque from the mainspring can be output at a more stable level.

In a timepiece according to another aspect of the invention the lever extends to the outside from the pivot point, and the distal end part of the lever is pushed by the pressure member, and the pressure member pushes the distal end part of the lever toward the pivot point side when the mainspring is fully wound, and pushes the distal end part of the lever so that the output torque of the output wheel increases as the mainspring unwinds.

This aspect of the invention achieves the same effect described above by changing the direction in which the lever applies pressure according to the winding state of the mainspring.

In a timepiece according to another aspect of the invention the pressure member includes a pressure wheel that is rotated at a reduced speed by the output wheel, and a pressure cam that is disposed in unison with the pressure wheel and moves from a position separated from the lever to a position contacting the lever as the mainspring unwinds, and the pressure cam pushes the lever so that the output torque of the output wheel increases when the pressure cam is in contact with the lever.

Because the torque increases proportionally to the specific speed reduction ratio between the pressure wheel and the output wheel, the lever that pivots synchronously to the output wheel can be pushed by the pressure cam disposed in unison with the pressure wheel. More specifically, because the pressure cam pushes against the lever near the end of the time that the mainspring can drive the timepiece normally (referred to as the timepiece operating time herein) when the pressure cam contacts the lever, the output torque of the mainspring can be augmented as the mainspring unwinds and the output torque decreases.

A timepiece according to another aspect of the invention preferably also has a sliding member and a guide member disposed to the lever. The sliding member can move linearly on a line between the pivot point end and the distal end of the lever. The guide member guides the sliding member along a chord of a circle of which the center is the pivot point of the lever, and guides the sliding member from the pivot point side to the distal end side of the lever as the mainspring unwinds. The pressure member pushes the lever by means of the intervening guide member and sliding member so that the output torque of the output wheel increases as the mainspring unwinds.

Because the lever is pushed indirectly by the intervening guide member and sliding member, the pressure of the pressure member on the guide member does not change as the lever pivots. As a result, the lever can be pushed stably with constant pressure.

In addition, because the sliding member moves from the pivot point end side to the distal end side of the lever as the mainspring unwinds, the pressure member pushes on the lever at a position that gradually moves away from the pivot point of the lever, and the torque produced on the output wheel by this pressure gradually increases as the mainspring unwinds. That is, the torque added to the output wheel increases as the torque output by the mainspring decreases, this additional torque appropriately augments the output torque of the mainspring, and the torque combining this additional torque and the output torque of the mainspring is substantially constant throughout the operating time of the timepiece. The timepiece precision is therefore more stable and the operating time of the timepiece can be extended.

In a timepiece according to another aspect of the invention the lever has an outside profile including at least a part of an ellipse, and the pressure point where the pressure member pushes against the lever changes as the mainspring unwinds from a position on the outside profile of the lever near the long axis side of the ellipse to a midpoint position between the long axis of the ellipse and the short axis of the ellipse.

By using a cam with a profile that includes at least part of an ellipse, the same effect achieved by the sliding member and guide member described above can be achieved by an even simpler arrangement. More specifically, because the direction of pressure from the pressure member gradually moves away from the pivot point of the lever as the mainspring unwinds, the torque added to the lever and the output wheel by the pressure from the pressure member increases gradually as the mainspring unwinds. That is, the torque added to the output wheel increases as the torque output by the mainspring decreases, this additional torque appropriately augments the output torque of the mainspring, and the torque combining this additional torque and the output torque of the mainspring is substantially constant throughout the operating time of the timepiece. The timepiece precision is therefore more stable and the operating time of the timepiece can be extended.

In a timepiece according to another aspect of the invention a recessed part is formed in a part of the outside profile of the lever so that the distance from the pivot point of the lever to the recessed part is shorter than the distance from the pivot point to other parts of the lever, the pressure member has a first member and a second member that is pushed by the first member and is disposed between the first member and the lever, the second member has a pawl that projects toward the lever and engages the recessed part, and the pressure point where the second member pushes against the lever changes from a position outside the recessed part to the recessed part as the mainspring unwinds.

When the second member pushes on the lever at any position outside the recessed part, the distal end of the pawl slides along the profile outside the recessed part of the lever, and this sliding resistance applies a load to the output wheel. As a result, when the output torque of the mainspring is greatest, this greatest torque is reduced proportionally to this load, and timekeeping precision can be stabilized.

When the mainspring then unwinds and the pawl of the second member engages the recessed part of the lever, the pawl pushes the lever so that the output torque of the output wheel increases. As a result, near the end of the operating time of the timepiece when the pawl engages the recessed part, the torque output by the mainspring, which is low at this point, can be assisted.

In a timepiece according to another aspect of the invention the pressure member is a spring member. This spring member can be manufactured by stamping flat spring stock. The spring member can therefore be manufactured easily and at a low cost, and can be reliably housed even in the limited space available inside a timepiece.

By combining the torque output from the mainspring and the torque produced by the output wheel, the invention drives the timepiece with torque having a flatter output curve, and thereby achieves stable precision and increases the timepiece operating time.

Other objects and attainments together with a fuller understanding of the invention will become apparent and appreciated by referring to the following description and claims taken in conjunction with the accompanying drawings.

DESCRIPTION OF PREFERRED EMBODIMENTS

Figure 1:
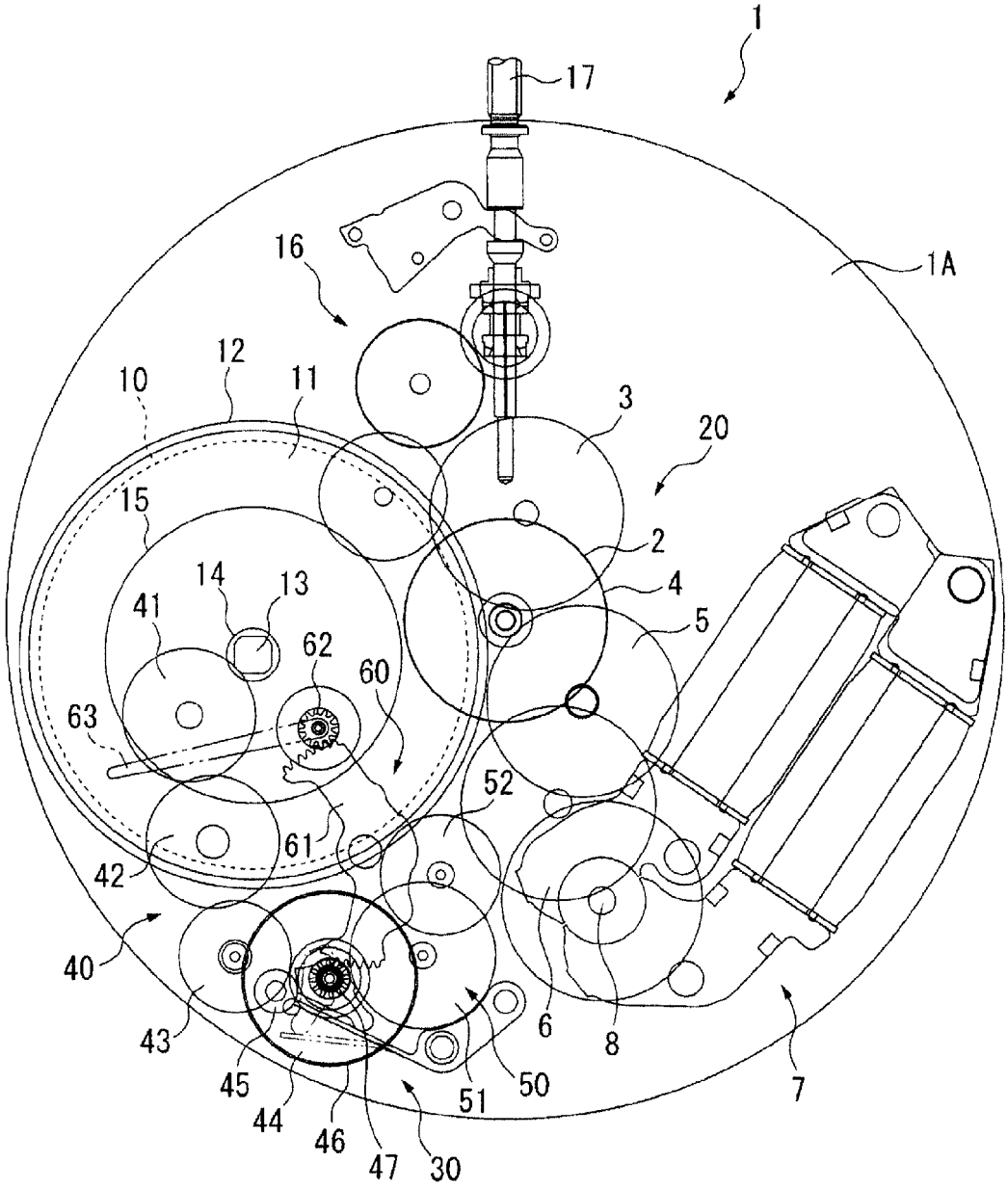
FIG. 1 is a schematic plan view of a timepiece according to a first embodiment of the invention.

Preferred embodiments of the present invention are described below with reference to the accompanying figures. Note that parts that are functionally the same as parts that have already been described are identified by the same reference numerals, and further description thereof is omitted.

Embodiment 1

FIG. 1 is a schematic plan view of a timepiece 1 according to a first embodiment of the invention. The timepiece 1 shown in FIG. 1 is an electronically-controlled mechanical timepiece that has a mainspring 10, a drive wheel train 20 that is powered by mechanical energy from the mainspring 10, and a reserve power display mechanism 30 that displays how much mechanical energy is left in the mainspring 10.

The mainspring 10 is contained in the barrel 11 with the outside end of the mainspring 10 attached to the barrel wheel 12 formed on the outside circumference of the barrel 11 when the timepiece 1 is a manually wound timepiece. If the timepiece 1 is a self-winding timepiece, the outside end of the mainspring 10 touches the inside circumference of the barrel 11 so that the mainspring 10 slides along the inside of the barrel 11 when torque exceeding a prescribed level is applied.

The inside end of the mainspring 10 is affixed to the barrel arbor 13 disposed at the center of the barrel 11. The barrel arbor 13 rotates in unison with a barrel arbor pinion 14, which can rotate in unison with a ratchet wheel 15.

The ratchet wheel 15 is connected to a winding unit 16. When the stem 17, which is a part of the winding unit 16, turns, the ratchet wheel 15 turns and the mainspring 10 is wound.

The drive wheel train 20 is a speed increasing wheel train including a second wheel 2 that meshes with the barrel wheel 12, a third wheel 3 that meshes with the second wheel 2, a fourth wheel 4 that is disposed coaxially to the second wheel 2 and meshes with the third wheel 3, a fifth wheel 5 that meshes with the fourth wheel 4, and a sixth wheel 6 that meshes with the fifth wheel 5. The minute hand is attached to a cannon pinion not shown disposed in unison with the second wheel 2, and the hour hand is attached to the hour wheel, to which rotation is transmitted from the cannon pinion through the day wheel. The second hand is attached to the end of the fourth wheel 4 pin.

In this embodiment of the invention in which the timepiece 1 is an electronically-controlled mechanism timepiece, rotation of the sixth wheel 6, which turns fastest, is transmitted to the rotor 8 of a generator 7. The electrical energy produced by the generator 7 controls rotation of the rotor 8 and governs the speed of the drive wheel train 20. The outside diameter of the second wheel 2 and the fourth wheel 4 is substantially the same, and the second wheel 2 and fourth wheel 4 are thus shown superimposed together in FIG. 1.

Figure 2:
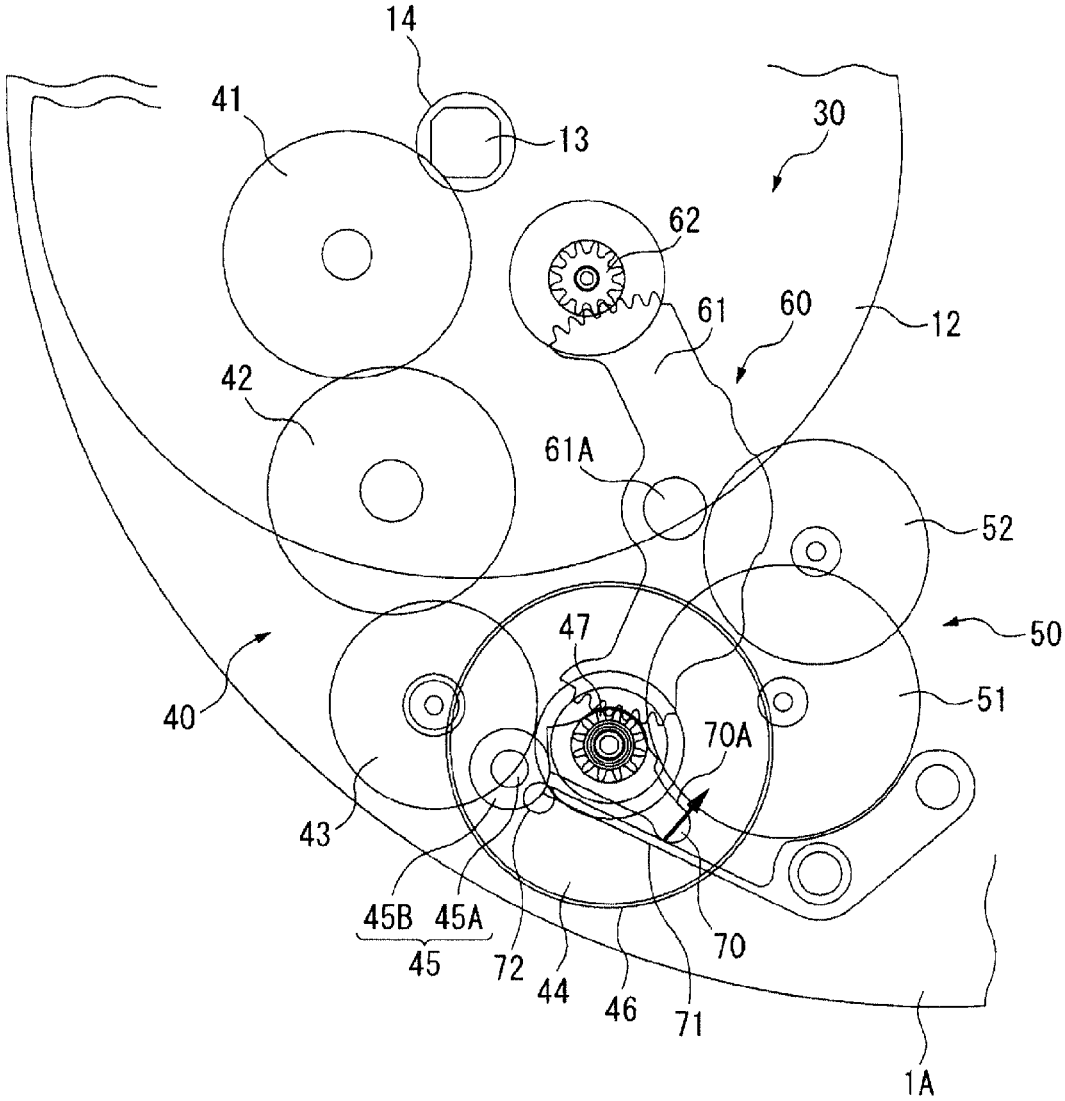
FIG. 2 is a plan view showing the main part of the timepiece.

FIG. 2 is an enlarged view of the reserve power display mechanism 30. As shown in FIG. 1 and FIG. 2, the reserve power display mechanism 30 includes a winding wheel train 40, an unwinding wheel train 50, and a reserve power wheel train 60.

The winding wheel train 40 has a first planet transmission wheel 41 that meshes with the barrel arbor pinion 14, a second planet transmission wheel 42 that meshes with the first planet transmission wheel 41, a third planet transmission wheel 43 that meshes with the second planet transmission wheel 42, a second sun wheel 44 that meshes with the third planet transmission wheel 43, a planet wheel 45 having a first planet wheel 45A that meshes with the second sun wheel 44 and a second planet wheel 45B rendered in unison with the first planet wheel 45A, a intermediate planet wheel 46 that is disposed coaxially to the second sun wheel 44 and affixed to enable the planet wheel 45 to rotate planetarily, and a sun wheel 47 that meshes with the second planet wheel 45B.

The unwinding wheel train 50 includes the sun wheel 47 as an output wheel, the planet wheel 45, the intermediate planet wheel 46, a fifth planet transmission wheel 51 that meshes with the intermediate planet wheel 46, and a fourth planet transmission wheel 52 that meshes with the fifth planet transmission wheel 51. The fourth planet transmission wheel 52 also engages the barrel wheel 12.

The reserve power wheel train 60 includes a rack wheel 61 that meshes with the sun wheel 47, and a reserve power indicator wheel 62 that meshes with the rack wheel 61. A reserve power indicator 63 is affixed to the reserve power indicator wheel 62. The rack wheel 61 has two curved racks each having a plurality of teeth formed at two locations on an imaginary circle centered on a center pin 61A. One rack meshes with the sun wheel 47, and the other rack meshes with the reserve power indicator wheel 62. The rack wheel 61 thus transmits the rotational movement of the sun wheel 47 to the reserve power indicator wheel 62, and affords greater freedom in the layout of the reserve power indicator 63.

When the barrel arbor pinion 14 turns as a result of the mainspring 10 winding operation using the winding wheel train 40, unwinding wheel train 50, and reserve power wheel train 60 described above, torque is transmitted from the first planet transmission wheel 41 to the second planet transmission wheel 42, the third planet transmission wheel 43, the second sun wheel 44, the planet wheel 45, and the sun wheel 47 as the speed of rotation is sequentially reduced. Because the barrel wheel 12 rotates slowly and is almost stationary when the mainspring 10 is wound, the wheel train from the intermediate planet wheel 46 to the fourth planet transmission wheel 52 is stationary, but the planet wheel 45 turns and rotates the sun wheel 47. The torque transferred to the sun wheel 47 is transmitted to the rack wheel 61 and reserve power indicator wheel 62, and the reserve power indicator 63 moves circularly.

When the mainspring 10 unwinds, the barrel arbor pinion 14 is stationary and the wheel train from the first planet transmission wheel 41 to the second sun wheel 44 is stopped. When the barrel wheel 12 then turns, the torque is transmitted from the fourth planet transmission wheel 52 to the fifth planet transmission wheel 51 and intermediate planet wheel 46 as the speed of rotation is gradually reduced. Because the second sun wheel 44 meshed with the second planet wheel 45B does not move at this time, the planet wheel 45 rotates while revolving around the second sun wheel 44. As a result, the sun wheel 47 meshed with the first planet wheel 45A rotates in the opposite direction as when the mainspring 10 is wound. The torque transmitted to this sun wheel 47 is transferred to the rack wheel 61 and reserve power indicator wheel 62, and the reserve power indicator 63 rotates in the opposite direction as when the mainspring 10 is wound.

The speed reduction ratio from the barrel wheel 12 (barrel arbor pinion 14) to the sun wheel 47 in this embodiment of the invention is set to 1/27 so that if the mainspring 10 is wound 7.5 turns (the angle of rotation is 360°×7.5=2700°), the sun wheel 47, that is, the reserve power indicator 63, rotates 100°. Note that this speed reduction ratio and the operating angle of the reserve power indicator 63 can be set desirably according to the size and design of the timepiece 1.

When the barrel arbor pinion 14 turns, torque corresponding to the amount the mainspring 10 is wound is transmitted and added to the sun wheel 47 as rotation in a specific direction. When the mainspring 10 unwinds and the barrel wheel 12 turns, torque corresponding to the amount the mainspring 10 unwinds is transmitted to the sun wheel 47 and subtracted as rotation in the opposite direction. The number of times the mainspring 10 is wound is thus computed by the winding wheel train 40 and unwinding wheel train 50 sharing a common sun wheel 47, and the number of winds in the mainspring 10 is indicated by the rotational position of the sun wheel 47.

The arrangement that is most characteristic of the invention is described next with reference to FIG. 2. As shown in FIG. 2, a sun wheel lever 70 extending from the center to the outside is affixed to the rotating shaft of the sun wheel 47. This sun wheel lever 70 rotates in conjunction with the sun wheel 47, and operates according to the reserve power left in the mainspring 10 and synchronously to the reserve power indicator 63. A spring member 71 acting as the pressure member of the invention contacts the distal end part of the sun wheel lever 70. The spring member 71 is manufactured by stamping flat spring stock, for example.

Figure 4:
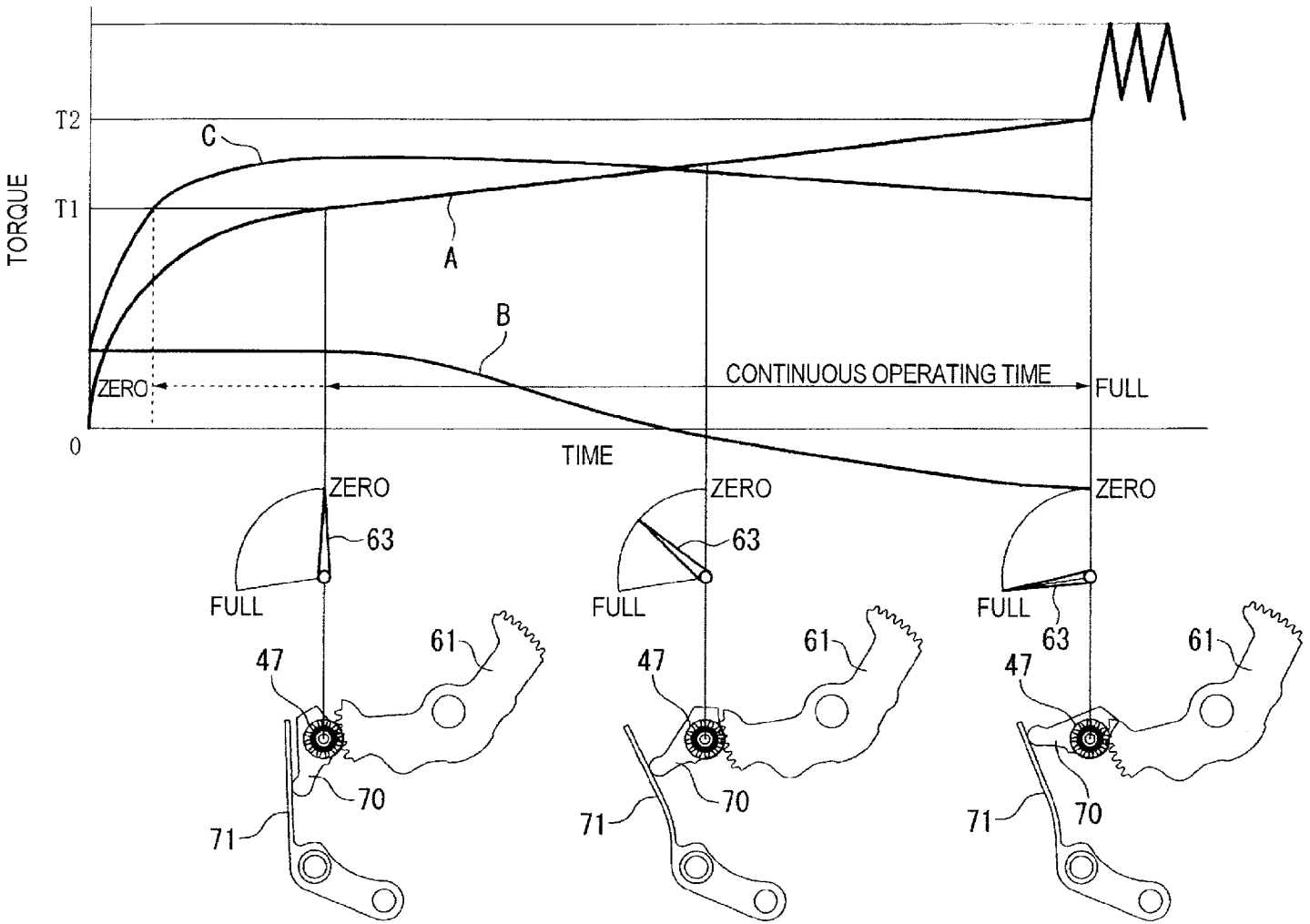
FIG. 4 describes the torque for driving the timepiece.

When the various components are positioned as shown in FIG. 2, the mainspring 10 is substantially completely unwound and the reserve power indicator 63 is positioned as shown in FIG. 4 when indicating a reserve power of substantially zero. The spring member 71 at this time pushes the sun wheel lever 70 in the counterclockwise direction (the direction indicated by the arrow in FIG. 2), that is, the direction of rotation when the mainspring 10 unwinds. When the operating time limit is reached, the one side 70A of the sun wheel lever 70 contacts the fifth planet transmission wheel 51 and stops further rotation of the sun wheel 47 in the unwinding direction. The mainspring 10 is thus prevented from unwinding further, the reserve power indicator 63 is prevented from pointing to a reserve power position less than zero, and the governor is prevented from becoming inoperable due to insufficient torque.

Figure 3:
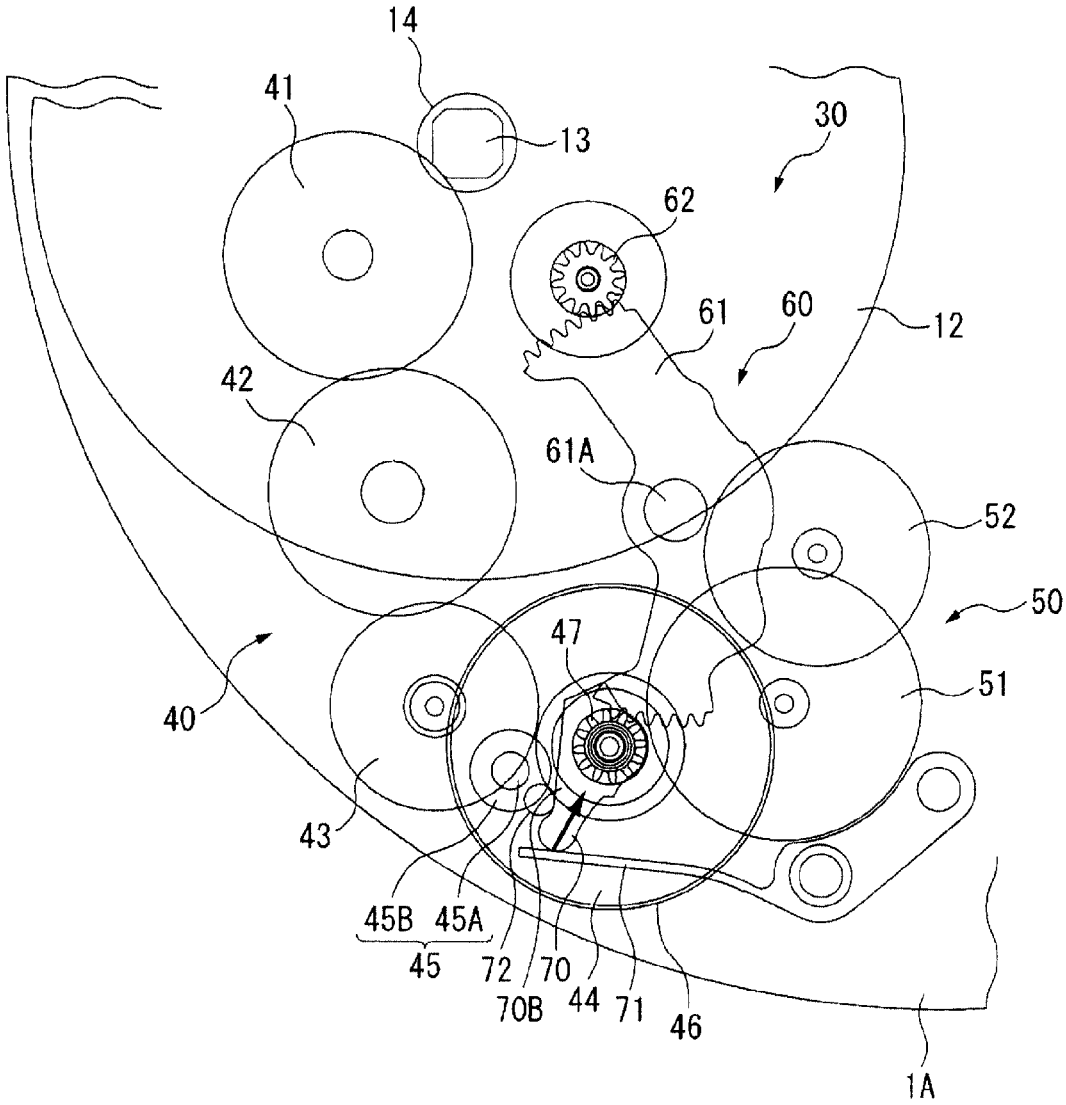
FIG. 3 is a plan view showing the main part of the timepiece in another state.

When positioned as shown in FIG. 3, however, the mainspring 10 is substantially fully wound and the reserve power indicator 63 is positioned as shown in FIG. 4 when indicating substantially full reserve power. The spring member 71 at this time pushes the sun wheel lever 70 toward the axis of rotation (the direction indicated by the arrow in FIG. 3). When the mainspring 10 is fully wound, the other side 70B of the sun wheel lever 70 contacts a pin 72 planted in the main plate 1A, and stops further rotation of the sun wheel 47 in the winding direction. The mainspring 10 is thus prevented from winding further, and the reserve power indicator 63 is prevented from pointing to a reserve power position greater than the full reserve power position.

The force of the spring member 71 pushing the sun wheel lever 70 toward its axis of rotation is greatest when the mainspring 10 is fully wound, and thus produces the greatest load when the mainspring 10 starts to unwind. The total torque driving the drive wheel train 20 is therefore reduced proportionally to this load. Conversely, because the spring member 71 pushes the sun wheel lever 70 in the unwinding direction when the mainspring 10 has unwound, the torque produced by this pressure works as an auxiliary force on the unwinding sun wheel 47. The total torque driving the drive wheel train 20 is therefore increased by this auxiliary torque transmitted from the sun wheel 47 side.

More specifically, as shown by curve B in FIG. 4, the torque produced on the sun wheel 47 by the spring member 71 pushing on the sun wheel lever 70 is lowest when the mainspring 10 is fully wound (becoming a load on the mainspring 10 when the mainspring 10 starts to unwind), and gradually increases as the mainspring 10 unwinds. As the mainspring 10 unwinds, the torque applied to the sun wheel 47 by the pressure from the spring member 71 begins to work in the direction assisting rotation of the sun wheel 47 in the direction decreasing the display value (to the unwound side), and this assistance increases as the spring unwinds. The total torque driving the drive wheel train 20 is thus the sum of the torque produced by the mainspring 10 and the torque produced by pressure from the sun wheel lever 70, and output follows the torque curve C in FIG. 4.

The effect of this embodiment of the invention is described next.

(1) During the continuous operating time of a conventional timepiece driven by a mainspring, the output torque drops from T2 to T1 as indicated by curve A, and the change in output torque is great. This causes a loss of timekeeping accuracy at both the winding and unwinding sides as described above.

The invention, however, minimizes the change in the output torque during the conventional remaining operating time, sustains substantially constant torque output, and thereby improves accuracy. As indicated by torque curve C, the minimum torque T1 required to drive the movement is sustained beyond the conventional remaining operating time, and thus increases the remaining operating time compared with the prior art as indicated by the dotted line in FIG. 4.

(2) Because the spring member 71 pushes the sun wheel lever 70 toward its axis of rotation when the mainspring 10 is fully wound, a load is applied to the mainspring 10 as it tries to unwind. Because a pin 72 prevents overwinding the mainspring 10 and the spring member 71 pushes the sun wheel lever 70 toward the angle of rotation, excessive torque from the mainspring 10 when the mainspring 10 is fully wound or nearly fully wound is reliably prevented from acting on the drive wheel train 20 and the governor unit. The timekeeping accuracy and the display accuracy of the timepiece can therefore be further improved.

(3) When the mainspring 10 is fully wound and outputting maximum torque, the spring member 71 is also maximally deflected and the load on the mainspring 10 is applied by the maximum spring force. As a result, excessive output torque from the mainspring 10 can be efficiently reduced.

Embodiment 2

A second embodiment of the invention is described next with reference to FIG. 5 and FIG. 6. This embodiment differs from the first embodiment in the arrangement of the pressure member that applies torque to the sun wheel.

Figure 5:
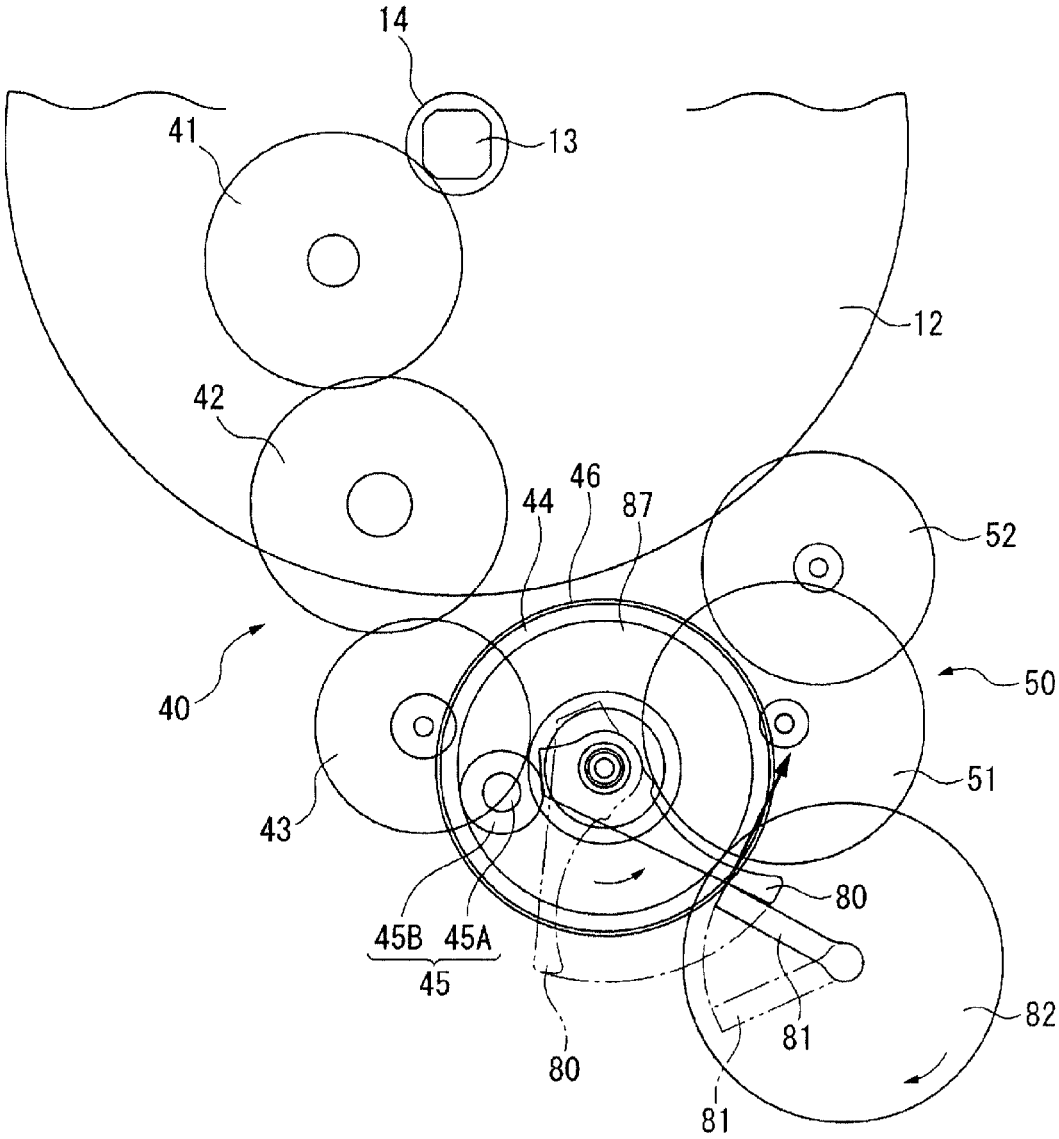
FIG. 5 is a plan view showing the main part of a timepiece according to a second embodiment of the invention.

FIG. 5 is a plan view showing the main part of a timepiece according to a second embodiment of the invention. A sun wheel lever 80 is affixed to the rotary shaft of the sun wheel 87 that is the output wheel in this embodiment of the invention.

The sun wheel lever 80 extends from the center of rotation in the direction intersecting the direction of sun wheel 87 rotation to a position beyond the outside edge of the sun wheel 87, and rotates synchronously to rotation of the sun wheel 87. The position of the sun wheel lever 80 indicated by the double-dot dash line in FIG. 5 is the position of the sun wheel lever 80 when the mainspring 10 is substantially fully wound, and the position indicated by the solid line is the position of the sun wheel lever 80 near the end of the timepiece operating time when the mainspring 10 is substantially fully unwound.

This embodiment does not have the reserve power display mechanism 30 or the pin 72 for stopping rotation of the sun wheel 47 in the winding direction that are provided in the first embodiment (FIG. 2), but substantially the same arrangement as the reserve power display mechanism 30 and pin 72 can be added to the arrangement shown in FIG. 5. This also applies to the third to fifth embodiments described below.

This embodiment of the invention also has a pressure wheel 82 that meshes with the sun wheel 87 and rotates at a slower speed than the sun wheel 87. The pressure member in this embodiment includes this pressure wheel 82 and a pressure cam 81 disposed in unison with the rotary shaft of the pressure wheel 82.

The pressure cam 81 extends from the end affixed to the rotary shaft of the pressure wheel 82 in a direction interesting the rotational direction of the pressure wheel 82. The position of the pressure cam 81 indicated by the double-dot dash line in FIG. 5 is the position of the pressure cam 81 when the mainspring 10 is substantially fully wound, and the position indicated by the solid line is the position of the pressure cam 81 near the end of the timepiece operating time when the mainspring 10 is substantially fully unwound.

Because the torque applied by the pressure wheel 82 to the sun wheel 87 is increased by the specific speed reduction ratio, the pressure cam 81 gradually approaches the sun wheel lever 80 from a position separated from the sun wheel lever 80 (the position indicated by the double-dot dash line in FIG. 5) until the pressure cam 81 contacts the sun wheel lever 80 as indicated by the solid line in FIG. 5. At this point the pressure cam 81 pushes the sun wheel lever 80 in the direction of the bold arrow in FIG. 5. This pressure from the pressure cam 81 applies torque to the sun wheel 87. This torque works as an auxiliary force on the sun wheel 87 that is rotating in the direction decreasing the display value when the mainspring 10 unwinds.

Figure 6:
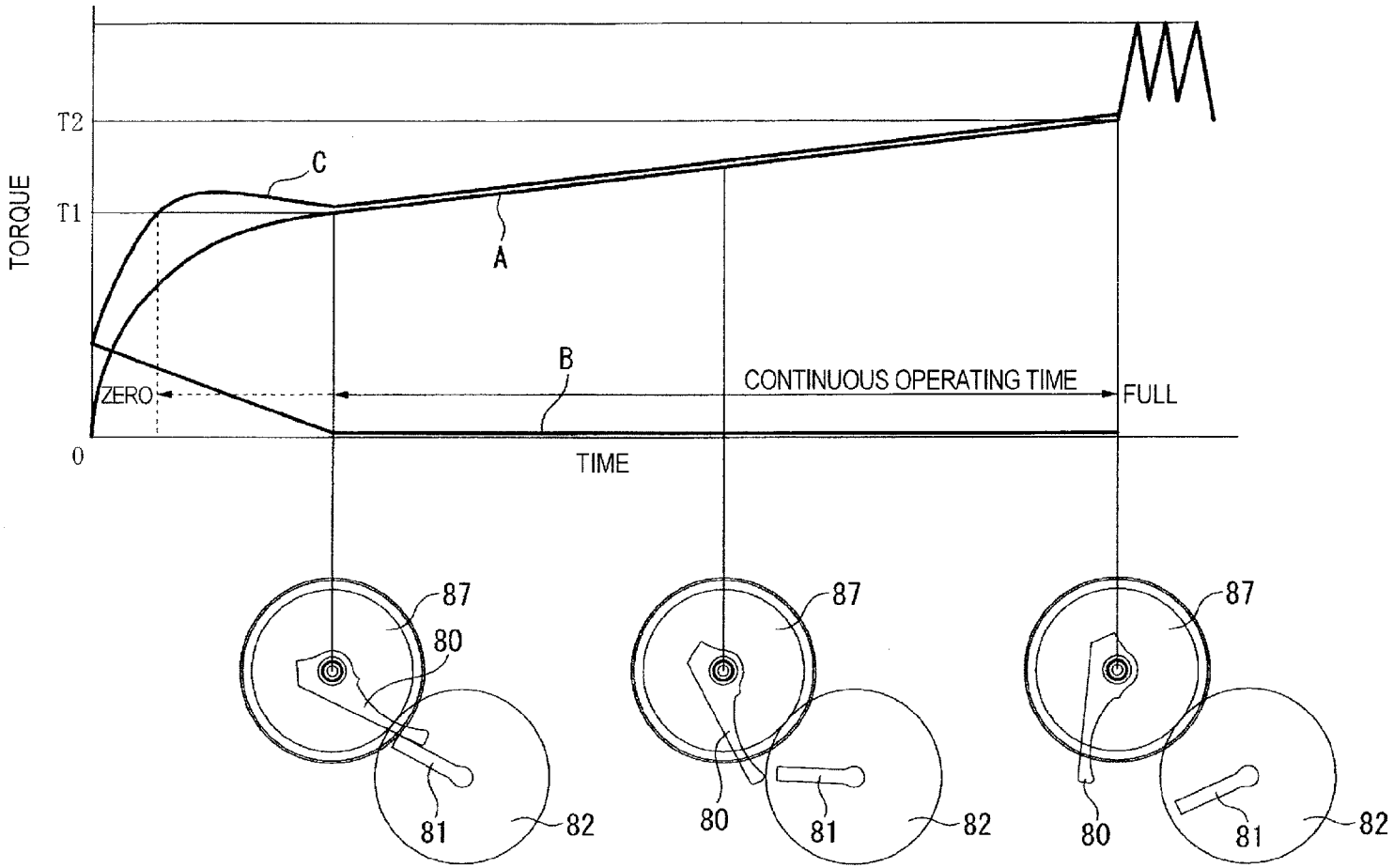
FIG. 6 describes the torque for driving the timepiece.

FIG. 6 shows the relationship between the torque for driving the timepiece and the remaining operating time of the timepiece in this embodiment of the invention. As in FIG. 4 describing the first embodiment, curves A to C denote the torque output by the mainspring 10 (curve A), the additional torque applied by the pressure member as auxiliary force causing the sun wheel 87 to rotate in the direction decreasing the display value (curve B), and the combined torque of the output torque from the mainspring 10 and the additional torque from the pressure member (curve C).

Because the pressure cam 81 is positioned away from the sun wheel lever 80 in this embodiment of the invention from when the mainspring 10 is fully wound until the mainspring 10 unwinds and the pressure cam 81 contacts the sun wheel lever 80, the additional torque from the pressure member (the pressure wheel 82 and pressure cam 81) is zero as indicated by curve B, and the combined torque of the additional torque and the output torque of the mainspring 10 is equal to the output torque of the mainspring 10 (curve C).

Additional torque is produced in this embodiment near the end of the remaining operating time when the pressure cam 81 contacts the sun wheel lever 80. This additional torque increases gradually as the mainspring 10 unwinds. The combined torque of this additional torque and the output torque of the mainspring 10 is increased by the additional torque as shown by curve C.

This second embodiment has the same effect as described in (1) in the effects of the first embodiment above.

Embodiment 3

A third embodiment of the invention is described next with reference to FIG. 7 to FIG. 9. The sun wheel lever is pushed directly by the pressure member (spring member 71) in the foregoing first embodiment, but the pressure member pushes the sun wheel lever indirectly by means of another member in this embodiment of the invention.

Figure 7:
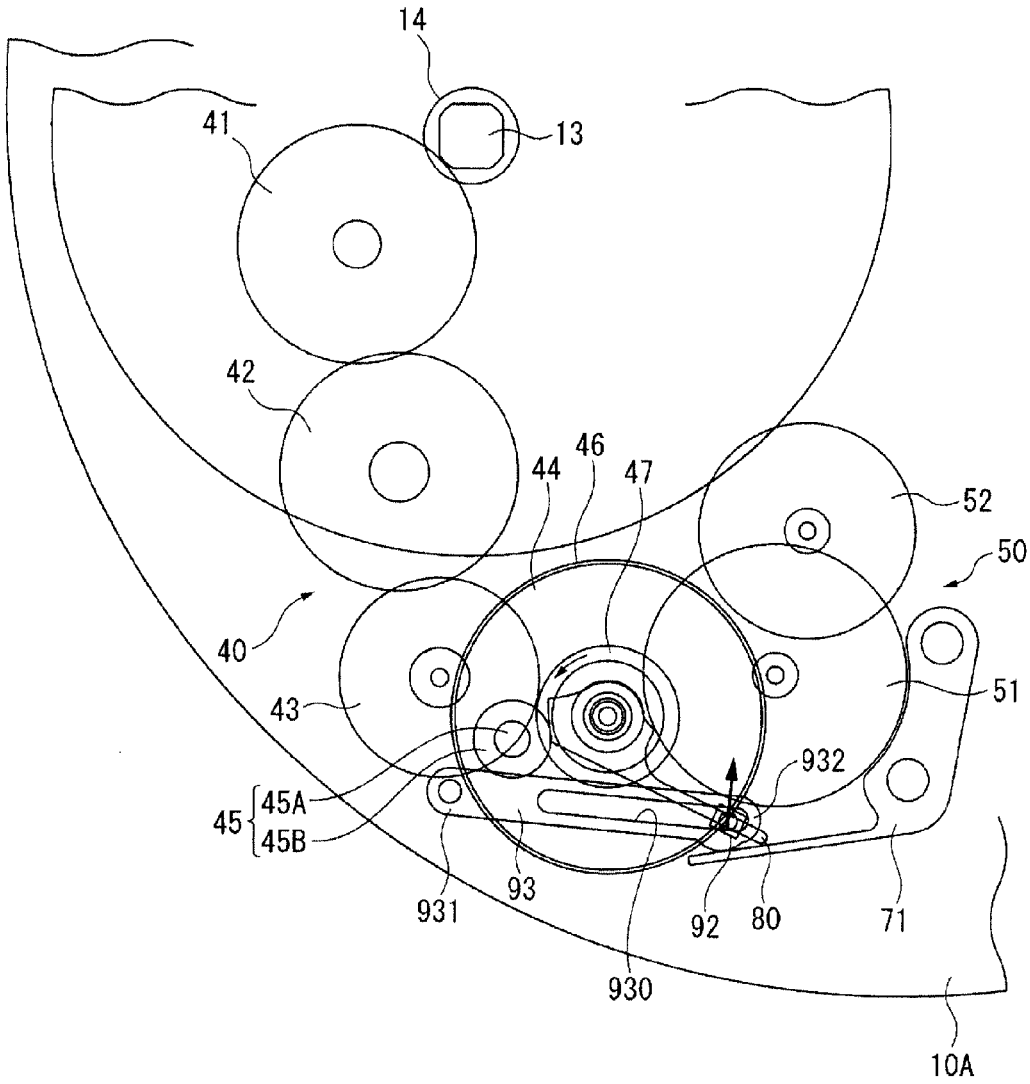
FIG. 7 is a plan view showing the main part of a timepiece according to a third embodiment of the invention.

FIG. 7 is a plan view showing the main part of a timepiece according to a third embodiment of the invention.

A slider 92 and a guide member 93 are disposed to the sun wheel lever 80. The slider 92 can move linearly on a line between the axis of rotation end and the distal end of the sun wheel lever 80, and the guide member 93 guides the slider 92 along a chord of a circle of which the center is the center of rotation of the sun wheel lever 80.

The guide member 93 has a slot 930 that engages a pin protruding from the slider 92. One end part 931 of the guide member 93 is fastened to the main plate 1A by a pin, and the spring member 71 applies pressure to the other end part 932. As a result, the spring member 71 applies pressure to the sun wheel lever 80 through the guide member 93 and the slider 92.

FIG. 7 shows the positions of these members when the mainspring 10 is substantially unwound and near the end of the remaining operating time of the timepiece. The slider 92 is positioned in the slot 930 at the opposite end as the axially supported end of the guide member 93 and near the distal end of the sun wheel lever 80. As a result, the spring member 71 pushes the sun wheel lever 80 in the direction of the bold arrow in FIG. 7. This pressure from the spring member 71 produces torque causing the sun wheel 47 to rotate in the direction decreasing the display value.

Figure 8:
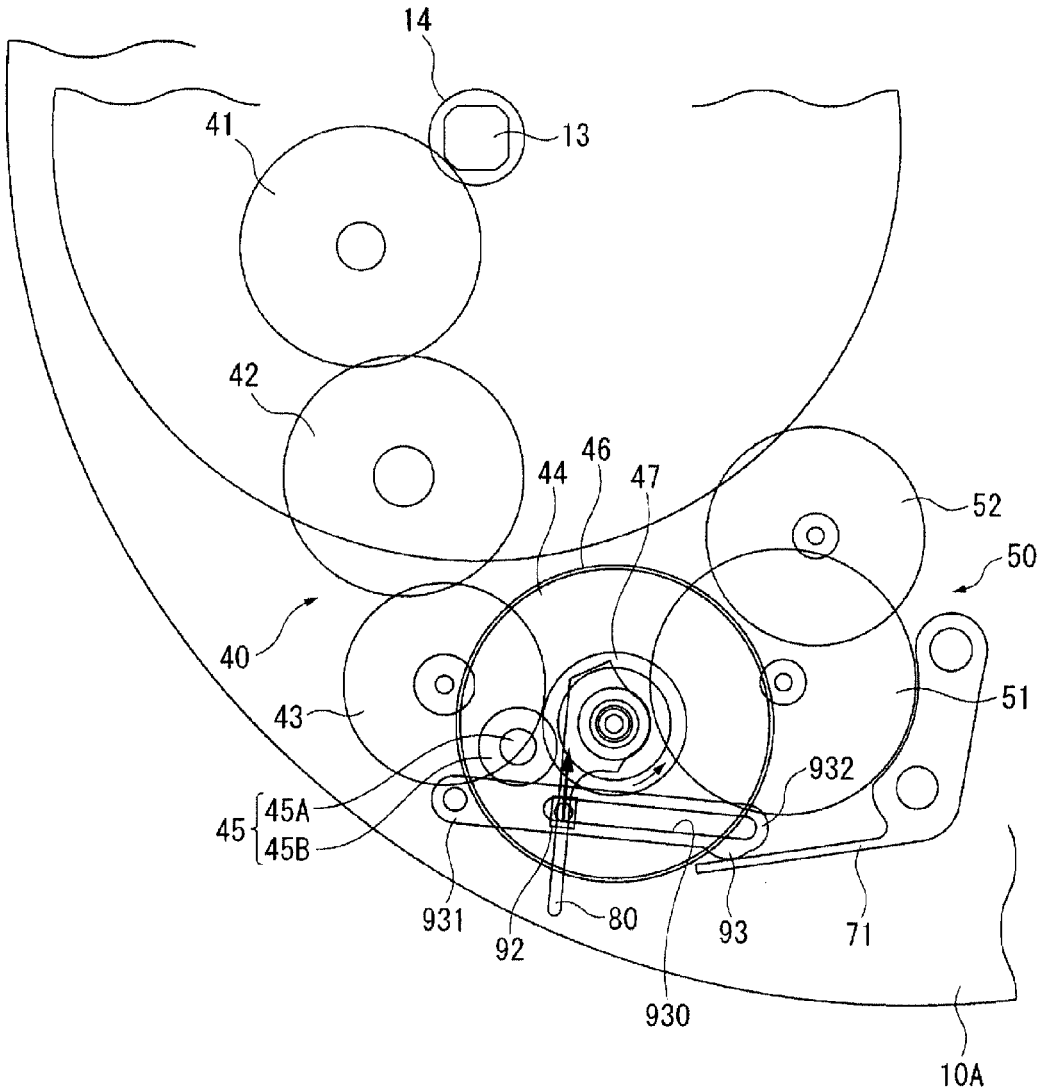
FIG. 8 is a plan view showing the main part of the timepiece in another state.

FIG. 8 shows the arrangement when the mainspring 10 is substantially fully wound. In this case the slider 92 is positioned in the slot 930 at the support pin end of the guide member 93 and near the base end of the sun wheel lever 80. As indicated by the bold arrow in FIG. 8, the spring member 71 pushes the sun wheel lever 80 in the direction toward the axis of rotation of the sun wheel lever 80, and thus applies a load resisting rotation of the winding wheel train 40. Torque causing the sun wheel 47 to rotate in the direction decreasing the display value is not applied in the condition shown in FIG. 8.

When the sun wheel lever 80 turns in this embodiment of the invention, the slider 92 moves along the guide member 93. Because the position of the guide member 93 does not change when the sun wheel lever 80 pivots, the deflection of the spring member 71 that applies pressure to the guide member 93 is constant. The spring member 71 thus pushes on the sun wheel lever 80 consistently with a constant spring force by means of the intervening slider 92 and guide member 93.

When the mainspring 10 unwinds from the position shown in FIG. 8, the slider 92 moves from the pivot axis end side to the distal end side of the sun wheel lever 80, and the position to which pressure is applied to the sun wheel lever 80 by the spring member 71 moves gradually away from the pivot axis end of the sun wheel lever 80. As a result, the additional torque applied to the sun wheel 47 increases as the mainspring 10 unwinds.

Figure 9:
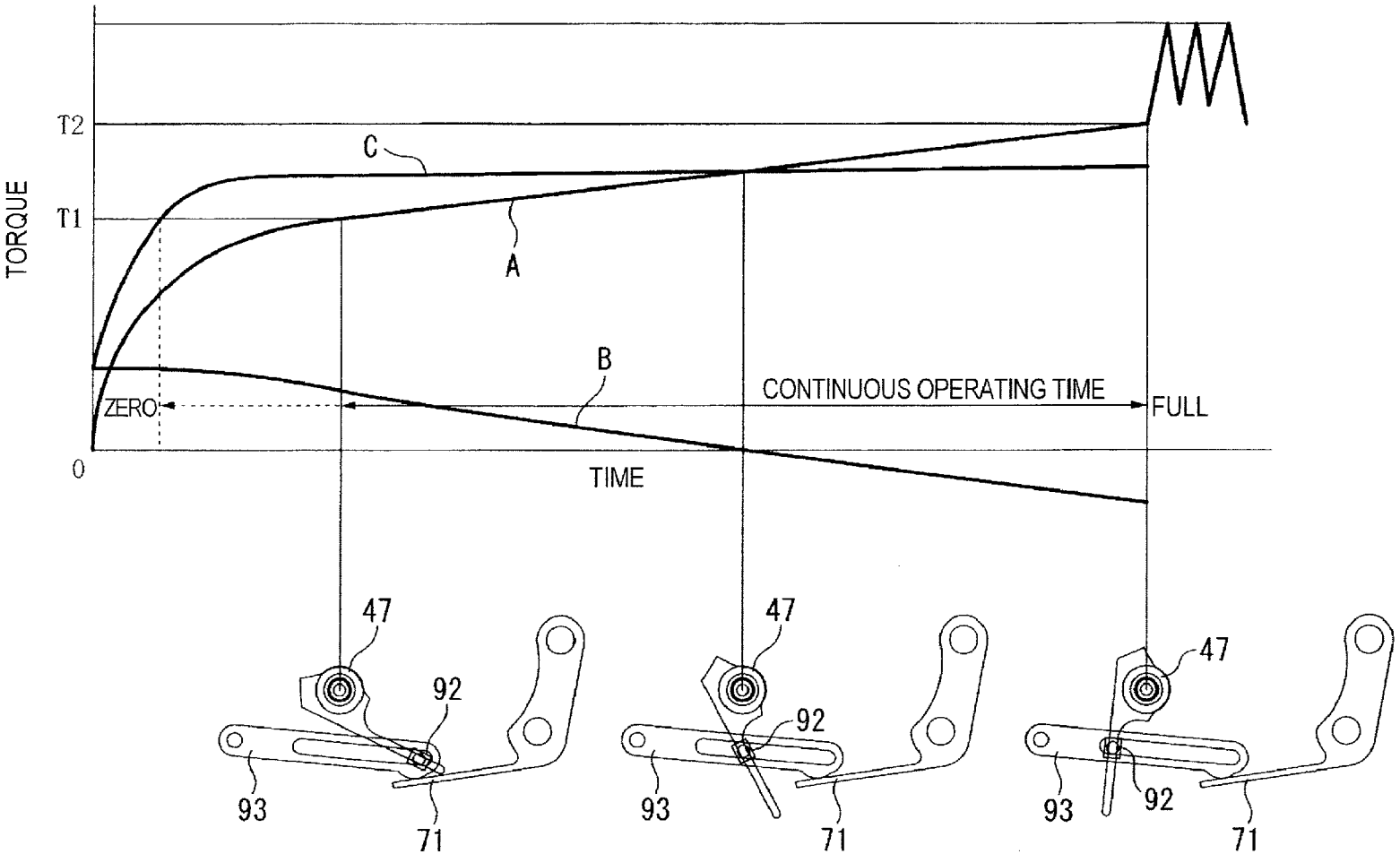
FIG. 9 describes the torque for driving the timepiece.

FIG. 9 shows the relationship between the torque for driving the timepiece and the remaining operating time of the timepiece in this embodiment of the invention. As in FIG. 4 describing the first embodiment, curves A to C denote the torque output by the mainspring 10 (curve A), the additional torque applied by the pressure member as auxiliary force causing the sun wheel 47 to rotate in the direction decreasing the display value (curve B), and the combined torque of the output torque from the mainspring 10 and the additional torque from the pressure member (curve C).

When the mainspring 10 is substantially fully wound (FIG. 8), the spring member 71 pushes the sun wheel lever 80 in the direction near the pivot axis of the sun wheel lever 80, and thus applies a load to rotation of the sun wheel 47. That is, a load is applied to the mainspring 10 as it tries to unwind. The torque applied by the spring member 71 to the sun wheel 47 in the direction decreasing the display value is the lowest at this time as shown by curve B in FIG. 9.

When the mainspring 10 then unwinds from this position, the slider 92 moves along the slot 930 in the guide member 93. As described above, the spring member 71 applies pressure to the sun wheel lever 80 with a constant spring force, and the position where the spring member 71 applies pressure to the sun wheel lever 80 changes with movement of the slider 92 from the pivot axis end side to the distal end side of the sun wheel lever 80. As a result, the additional torque applied by the spring member 71 to the sun wheel 47 gradually increases, and works as an auxiliary force causing the sun wheel 47 to rotate in the direction decreasing the display value. The combined torque of this additional torque and the output torque of the mainspring 10 is increased by the additional torque from the spring member 71 as shown by curve C in FIG. 9.

Because the position where the spring member 71 pushes on the sun wheel lever 80 changes as the slider 92 moves, the torque added to the sun wheel 47 increases as the output torque of the mainspring 10 decreases as the mainspring 10 unwinds. Because the output torque of the mainspring 10 is thus desirably augmented by this additional torque applied to the sun wheel 47, the combined torque of the spring output torque and the additional torque is substantially constant throughout the operating time of the timepiece as shown in FIG. 9.

In addition to the effects described in (1) and (2) in the effects of the first embodiment above, this third embodiment also has the following effect.

(4) The torque combining the additional torque from the spring member 71 and the output torque of the mainspring 10 is substantially constant throughout the operating time of the timepiece because the sun wheel lever 80 is pushed with a constant spring force by the intervening slider 92 and guide member 93, and the position to which pressure is applied to the sun wheel lever 80 changes as the slider 92 moves. As a result, timekeeping precision is even more stable, and the operating time of the timepiece can be further extended.

Embodiment 4

A fourth embodiment of the invention is described next with reference to FIG. 10 to FIG. 12. This embodiment differs from the foregoing embodiments in the shape of the sun wheel lever.

Figure 10:
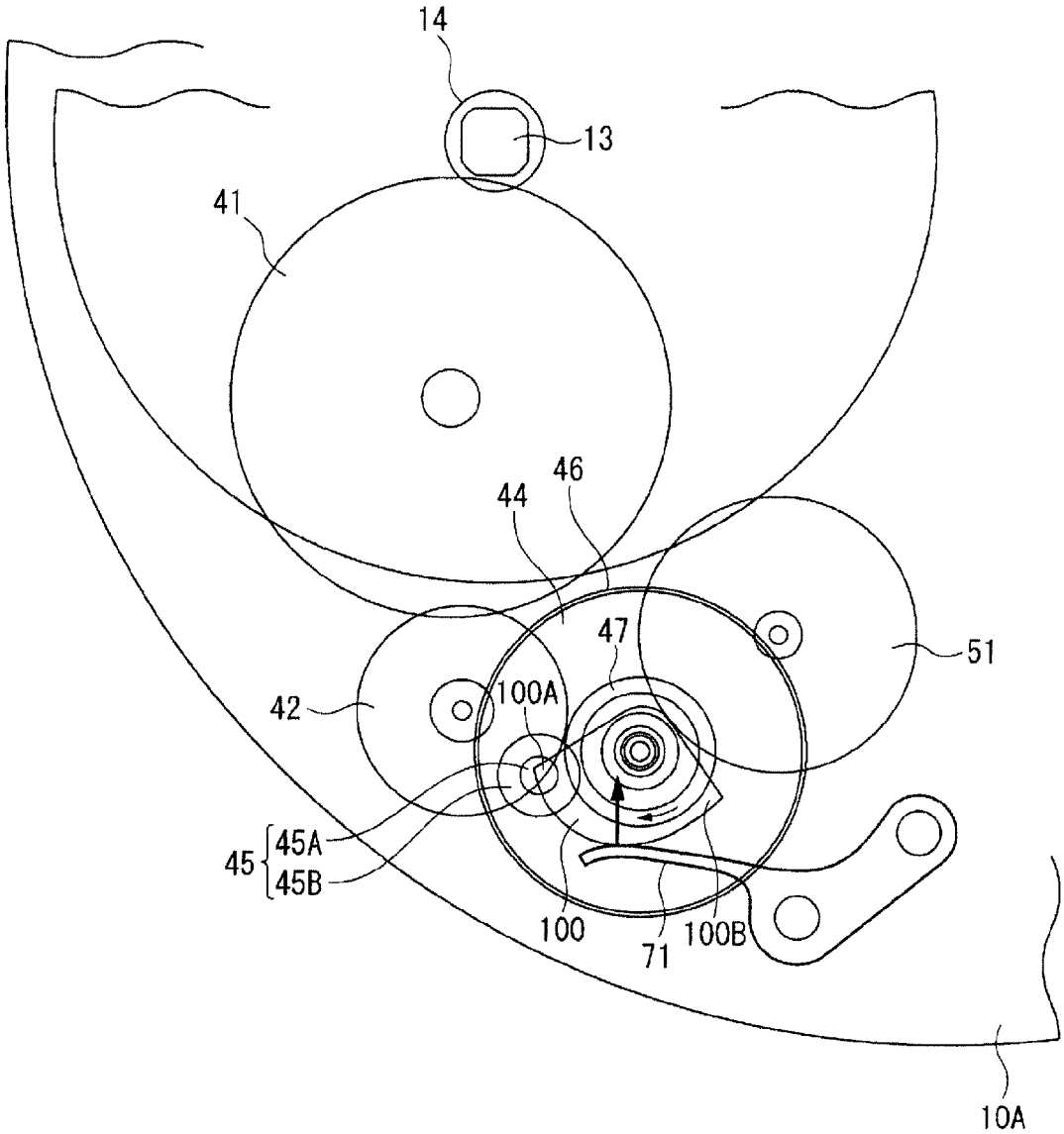
FIG. 10 is a plan view showing the main part of a timepiece according to a fourth embodiment of the invention.

FIG. 10 is a plan view showing the main part of a timepiece according to this fourth embodiment of the invention. This embodiment uses a sun wheel cam 100 instead of a lever. The profile of this sun wheel cam 100 is approximately ¼ of an oval.

This embodiment also differs from the foregoing embodiments in not having a third planet transmission wheel 43 and fourth planet transmission wheel 52, the second planet transmission wheel 42 meshing with the second sun wheel 44, and the fifth planet transmission wheel 51 meshing with the barrel wheel 12. This arrangement causes the sun wheel 47 to rotate in the opposite direction as the sun wheels in the previous embodiments (clockwise in FIG. 10), and provides more space on the main plate 10A for disposing the spring member 71 that pushes against the sun wheel cam 100. However, if space for installing the spring member 71 can be provided on the left side of the main plate 10A in FIG. 10, the wheel train can be provided with the third planet transmission wheel 43 and fourth planet transmission wheel 52 as in the previous embodiments.

FIG. 10 shows the positions of these members when the mainspring 10 is substantially unwound and near the end of the remaining operating time of the timepiece. The spring member 71 pushes against substantially the midpoint of the cam profile between the long axis side 100A where the distance from the center of sun wheel cam 100 rotation is long and the short axis side 100B where the distance from the center of rotation is short. As a result, the spring member 71 applies pressure in the direction causing the sun wheel 47 to rotate in the direction decreasing the display value as indicated by the bold arrow in FIG. 10, and torque is thus added to the sun wheel 47.

Figure 11:
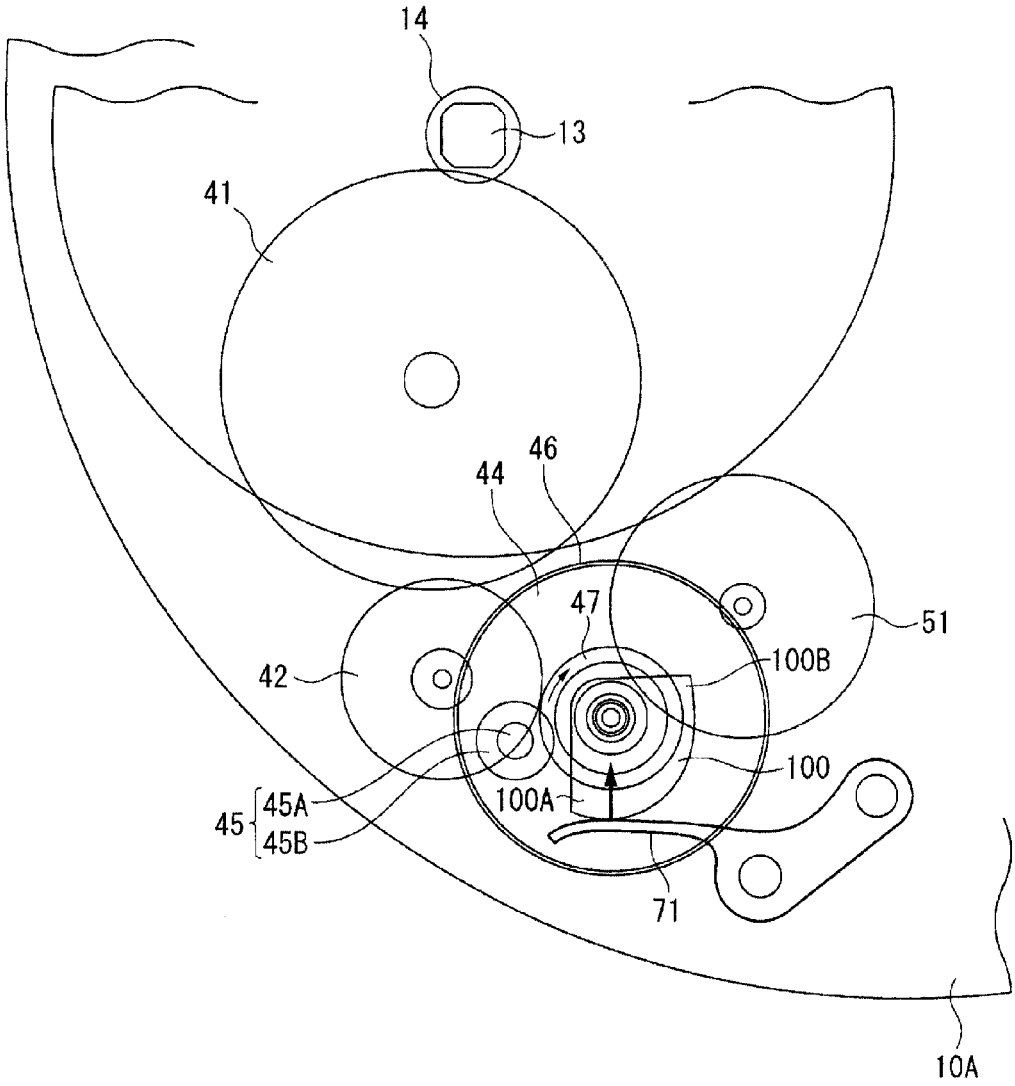
FIG. 11 is a plan view showing the main part of the timepiece in another state.

FIG. 11 shows the same arrangement when the mainspring 10 is substantially fully wound. In this case the spring member 71 applies pressure to the long axis side 100A where the distance from the center of sun wheel cam 100 rotation is long. As indicated by the bold arrow in FIG. 11, the pressure from the spring member 71 is applied towards the center of sun wheel cam 100 rotation, and a load is thus applied to the sun wheel 47. When positioned as shown in FIG. 11, torque causing the sun wheel 47 to rotate in the direction decreasing the display value is not applied.

When the mainspring 10 unwinds from the position shown in FIG. 11, the position where the spring member 71 applies pressure to the sun wheel cam 100 changes from a position near the long axis side 100A (see FIG. 11) to the midpoint between the long axis side 100A and the short axis side 100B (see FIG. 10). Rotation of the sun wheel cam 100 thus causes the direction of the pressure from the spring member 71 (the direction perpendicular to the tangent of the sun wheel cam 100 and spring member 71 (normal direction)) to move gradually away from the axis of sun wheel cam 100 rotation. The separation distance from the rotational center of the sun wheel cam 100 in this pressure direction to the side causing the sun wheel 47 to rotate in the direction decreasing the display value gradually increases from the position where the spring member 71 touches the profile near the long axis side 100A (FIG. 11) to the position where the spring member 71 touches the profile at the midpoint between the long axis side 100A and short axis side 100B (FIG. 10). The moment causing the sun wheel cam 100 to rotate is the product of the pressure corresponding to the distance from the rotational axis of the sun wheel cam 100 to the point where the spring member 71 applies pressure and the separation distance from the rotational axis of the sun wheel cam 100 in the pressure direction, and is greatest when the sun wheel cam 100 and spring member 71 are positioned as shown in FIG. 11. As a result, the additional torque on the sun wheel 47 increases as the mainspring 10 unwinds.

The profile of the sun wheel cam 100 in this embodiment is approximately ¼ of an oval, but the invention is not limited to this profile. More particularly, the profile of the sun wheel cam 100 could be the ⅛ of an oval including the midpoint between this long axis part 100A and the short axis part 100B.

Figure 12:
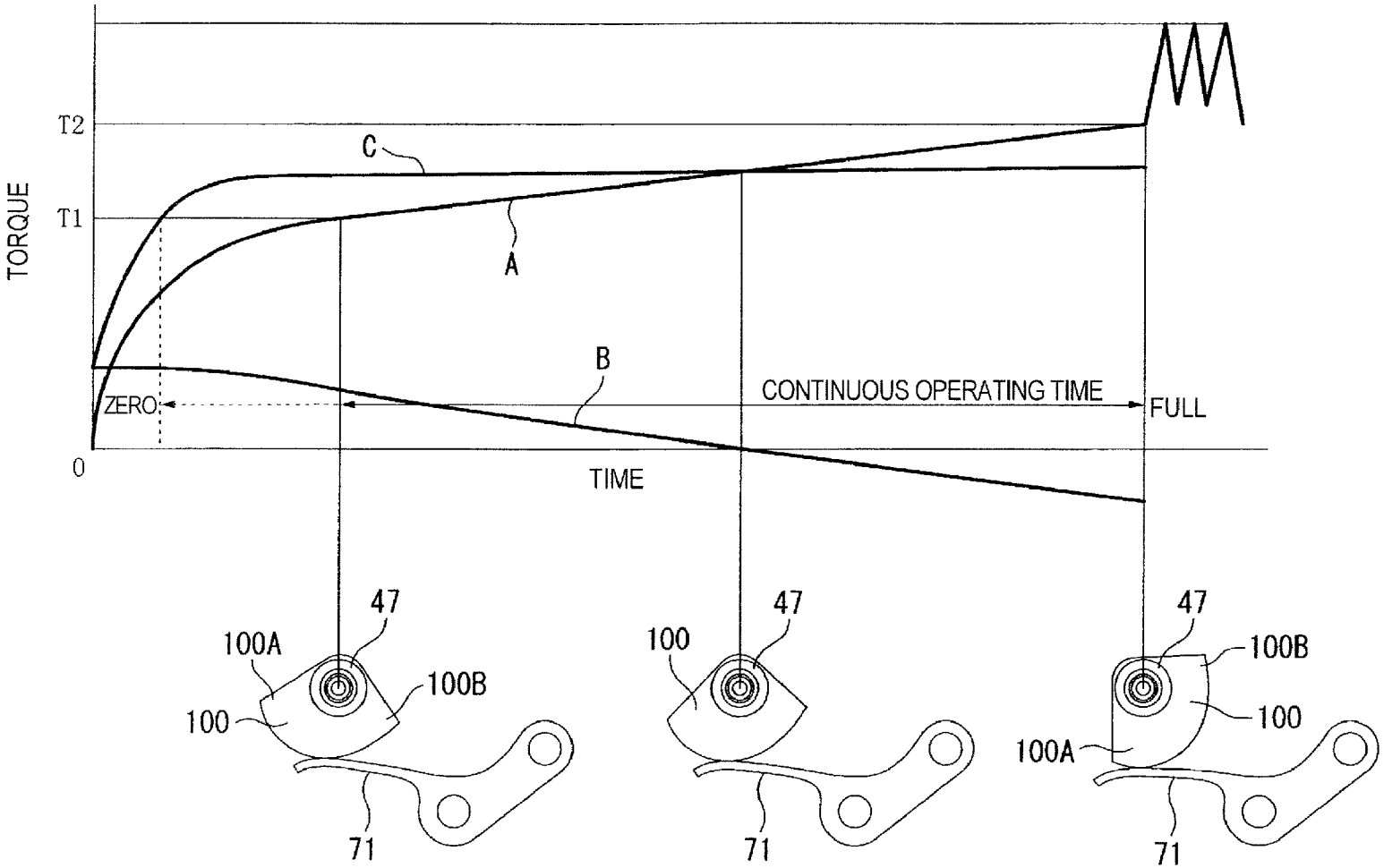
FIG. 12 describes the torque for driving the timepiece.

FIG. 12 shows the relationship between the torque for driving the timepiece and the remaining operating time of the timepiece in this embodiment of the invention. As in FIG. 4 describing the first embodiment, curves A to C denote the torque output by the mainspring 10 (curve A), the additional torque applied by the pressure member as auxiliary force causing the sun wheel 47 to rotate in the direction decreasing the display value (curve B), and the combined torque of the output torque from the mainspring 10 and the additional torque from the pressure member (curve C). The relationship between these torque levels and the operating time of the timepiece is the same as in the third embodiment (FIG. 9).

When the mainspring 10 is substantially fully wound (FIG. 11), the spring member 71 pushes the sun wheel cam 100 towards the center of rotation, thus applies a load on the sun wheel 47, and thereby applies a load on the mainspring 10. The torque applied by the spring member 71 to the sun wheel 47 in the direction decreasing the display value is the lowest at this time as shown by curve B in FIG. 12.

When the mainspring 10 then unwinds from this position, the pressure point of the spring member 71 on the sun wheel cam 100 changes from near the long axis side 100A to the midpoint between the long axis side 100A and short axis side 100B, the additional torque applied by the spring member 71 to the sun wheel 47 gradually increases, and this additional torque works as an auxiliary force causing the sun wheel 47 to rotate in the direction decreasing the display value. The combined torque of this additional torque and the output torque of the mainspring 10 is increased by the additional torque produced by the spring member 71 as shown by curve C in FIG. 12.

The torque added to the sun wheel 47 increases as the output torque of the mainspring 10 decreases as the mainspring 10 unwinds. Because the output torque of the mainspring 10 is thus desirably augmented by this additional torque applied to the sun wheel 47, the combined torque of the spring output torque and the additional torque is substantially constant throughout the operating time of the timepiece as shown in FIG. 12.

In addition to the effects described in (1) and (2) in the effects of the first embodiment above, this fourth embodiment also has the following effect.

(5) By using a sun wheel cam 100 with an outside profile including the outline of part of an oval, timekeeping precision is rendered even more stable and the operating time of the timepiece can be further extended by means of a simple arrangement.

Embodiment 5

A fifth embodiment of the invention is described next with reference to FIG. 13 to FIG. 15. This embodiment differs from the foregoing embodiments in the arrangement of the sun wheel lever and the arrangement of the pressure member.

Figure 13:
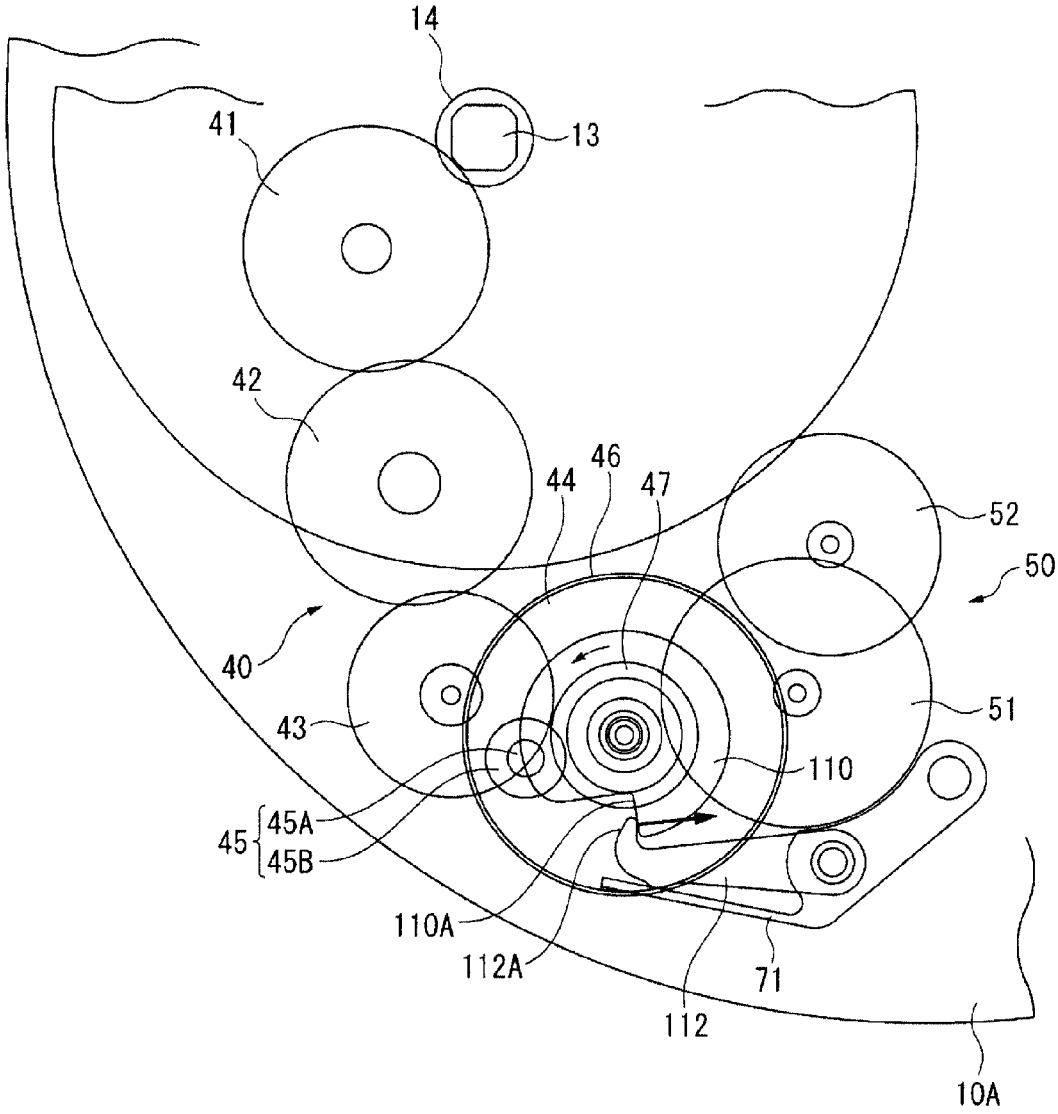
FIG. 13 is a plan view showing the main part of a timepiece according to a fifth embodiment of the invention.

FIG. 13 is a plan view showing the main part of a timepiece according to this fifth embodiment of the invention. This embodiment uses a sun wheel cam 110 that functions substantially identically to the sun wheel lever in the embodiments described above. A catch 110A formed as a substantially V-shaped recess in from the outside edge is formed at one place on the outside of the sun wheel cam 110 profile.

The pressure member in this embodiment has a spring member 71 as a first member and a secondary pressure member 112. The secondary pressure member 112 is supported by a pin on the spring member 71, and intercedes between the spring member 71 and the sun wheel cam 110.

The secondary pressure member 112 has a pawl 112A that projects toward the sun wheel cam 110 and engages the catch 110A.

FIG. 13 shows the positions of these members when the mainspring 10 is substantially unwound and near the end of the remaining operating time of the timepiece. At this time the pawl 112A of the secondary pressure member 112 engages the inside face of the catch 110A on the sun wheel cam 110. The spring member 71 therefore pushes against the sun wheel cam 110 by means of the intervening secondary pressure member 112 in the direction of the bold arrow in FIG. 13. This pressure from the spring member 71 and secondary pressure member 112 applies torque in the direction causing the sun wheel 47 to rotate in the direction decreasing the display value.

Figure 14:
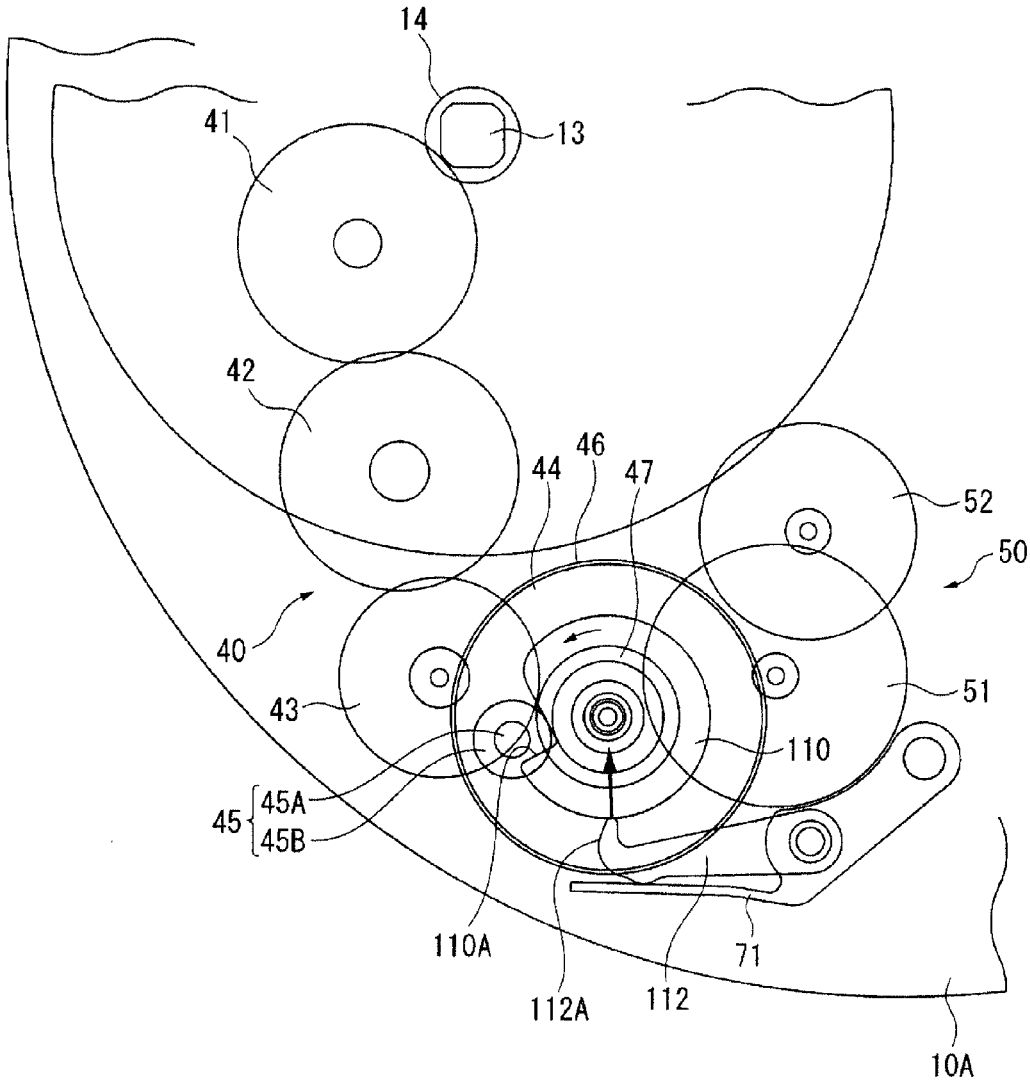
FIG. 14 is a plan view showing the main part of the timepiece in another state.

FIG. 14 shows the same arrangement when the mainspring 10 is substantially fully wound. As indicated by the bold arrow in FIG. 14, the pawl 112A pushes the sun wheel cam 110 in the direction toward the center of sun wheel cam 110 rotation in this embodiment from when the mainspring 10 is fully wound until the mainspring 10 unwinds and the secondary pressure member 112 engages the catch 110A. The pawl 112A slides along the outside of the sun wheel cam 110 during this time, and the resulting sliding resistance applies a load to the sun wheel 47.

Figure 15:
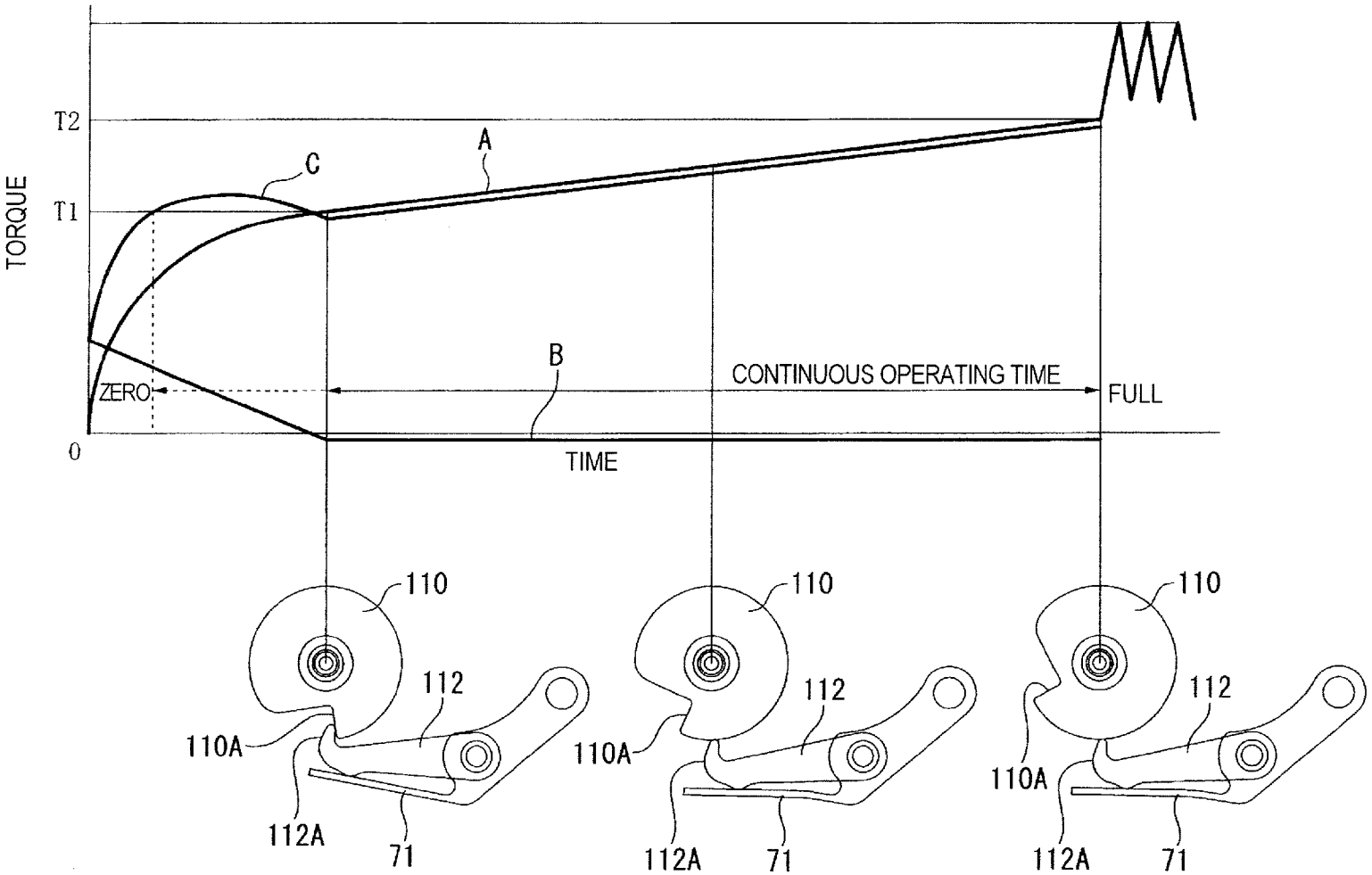
FIG. 15 describes the torque for driving the timepiece.

FIG. 15 shows the relationship between the torque for driving the timepiece and the remaining operating time of the timepiece in this embodiment of the invention. As in FIG. 4 describing the first embodiment, curves A to C denote the torque output by the mainspring 10 (curve A), the additional torque applied by the pressure member as auxiliary force causing the sun wheel 47 to rotate in the direction decreasing the display value (curve B), and the combined torque of the output torque from the mainspring 10 and the additional torque from the pressure member (curve C).

A load is applied to the rotation of the sun wheel 47 as indicated by curve B in this embodiment from when the mainspring 10 is fully wound until the mainspring 10 unwinds and the pawl 112A engages the catch 110A.

The direction of the applied pressure then changes when the pawl 112A engages the catch 110A. More specifically, the pawl 112A pushes the inside face of the catch 110A in the direction of the arrow in FIG. 13, and thus produces torque causing the sun wheel 47 to rotate in the direction decreasing the display value. The combined torque of this additional torque and the output torque of the mainspring 10 is increased by this additional torque as shown by curve C.

This second embodiment has the same effect as described in (1) in the effects of the first embodiment above.

The invention is not limited to the embodiments described above and variations and improvements achieving the same object are included in the scope of the invention.

For example, the sun wheel lever 70 used as the lever in the accompanying claims is attached to the sun wheel 47 in the first embodiment. However, the lever of the invention only needs to rotate synchronously to the sun wheel 47 or other output wheel. As a result, a wheel that meshes with and thereby rotates synchronously to the output wheel can be separately provided, and the lever can be mounted on this separate wheel.

The embodiments described above increase the output torque of the sun wheel 47 by pushing a lever 70 that turns synchronously to a sun wheel 47 that indicates the number of winds in the mainspring 10, but the output wheel that is pushed by this pressure member is not limited to this type of sun wheel 47. For example, one of the wheels in the drive wheel train 20 or a separate wheel that turns in cooperation with a wheel in the drive wheel train 20 can be used as the output wheel.

The embodiment described above has a reserve power display mechanism 30 for displaying how much power is left in the mainspring 10, but this reserve power display mechanism 30 can be incorporated as necessary or not incorporated at all.

The foregoing embodiments are also described using a spring member as the pressure member of the invention, but the pressure member is not limited to a spring member. For example, the pressure member could produce pressure by means of the elasticity of a rubber or other type of elastic member.

The timepiece of the invention is also not limited to an electronically-controlled mechanism timepiece having a generator 7 as described in the foregoing embodiments, and could be a mechanical timepiece that uses an escapement and balance as a governor.

The shapes of the lever and the pressure member are also not limited to those described in the foregoing embodiments. For example, the profile of the sun wheel cam 110 in the fifth embodiment outside of the catch could be elliptical like the sun wheel cam 100 in the fourth embodiment. This arrangement achieves the effect of the fourth embodiment and the effect of the fifth embodiment.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

The entire disclosure of Japanese Patent Application Nos: 2007-080865, filed Mar. 27, 2007 and 2007-319271, filed Dec. 11, 2007 are expressly incorporated by reference herein.

What is claimed is:

1. A timepiece comprising:

a mainspring;

an output wheel that is rotated by torque output from the mainspring;

a lever that pivots synchronously to the output wheel; and a pressure member that pushes the lever;

wherein the pressure member pushes the lever so that the output torque of the output wheel increases as the mainspring unwinds.

2. The timepiece described in claim 1, wherein:

the pressure member pushes the lever to the lever pivot point or near the lever pivot point when the mainspring is fully wound, and pushes the lever so that the output torque of the output wheel increases as the mainspring unwinds.

3. The timepiece described in claim 2, wherein:

the lever extends to the outside from the pivot point, and the distal end part of the lever is pushed by the pressure member; and the pressure member pushes the distal end part of the lever toward the pivot point side when the mainspring is fully wound, and pushes the distal end part of the lever so that the output torque of the output wheel increases as the mainspring unwinds.

4. The timepiece described in claim 1, wherein:

the pressure member includes a pressure wheel that is rotated at a reduced speed by the output wheel, and a pressure cam that is disposed in unison with the pressure wheel and moves from a position separated from the lever to a position contacting the lever as the mainspring unwinds; and the pressure cam pushes the lever so that the output torque of the output wheel increases when the pressure cam is in contact with the lever.

5. The timepiece described in claim 1, further comprising a sliding member and a guide member disposed to the lever;

wherein the sliding member can move linearly on a line between the pivot point end and the distal end of the lever;

the guide member guides the sliding member along a chord of a circle of which the center is the pivot point of the lever;

the guide member guides the sliding member from the pivot point side to the distal end side of the lever as the mainspring unwinds; and the pressure member pushes the lever by means of the intervening guide member and sliding member so that the output torque of the output wheel increases as the mainspring unwinds.

6. The timepiece described in claim 1, wherein:

the lever has an outside profile including at least a part of an ellipse; and the pressure point where the pressure member pushes against the lever changes as the mainspring unwinds from a position on the outside profile of the lever near the long axis side of the ellipse to a midpoint position between the long axis of the ellipse and the short axis of the ellipse.

7. The timepiece described in claim 1, wherein:

a recessed part is formed in a part of the outside profile of the lever so that the distance from the pivot point of the lever to the recessed part is shorter than the distance from the pivot point to other parts of the lever;

the pressure member has a first member and a second member that is pushed by the first member and is disposed between the first member and the lever;

the second member has a pawl that projects toward the lever and engages the recessed part; and the pressure point where the second member pushes against the lever changes from a position outside the recessed part to the recessed part as the mainspring unwinds.

8. The timepiece described in claim 1, wherein:

the pressure member is a spring member.

* * * * *